US008353655B2

(12) United States Patent
Rainer

(10) Patent No.: US 8,353,655 B2
(45) Date of Patent: Jan. 15, 2013

(54) FLOOR ANCHOR

(75) Inventor: Stephan Rainer, Plattling (DE)

(73) Assignee: Krinner Innovation GmbH (DE)

( * ) Notice: Subject to any disclaimer, the term of this patent is extended or adjusted under 35 U.S.C. 154(b) by 0 days.

(21) Appl. No.: 13/197,523

(22) Filed: Aug. 3, 2011

(65) Prior Publication Data

US 2011/0314749 A1 Dec. 29, 2011

Related U.S. Application Data

(63) Continuation of application No. PCT/EP2009/004994, filed on Jul. 9, 2009.

(30) Foreign Application Priority Data

Feb. 13, 2009 (DE) ..... 10 2009 003 477

(51) Int. Cl.
*F16B 25/10* (2006.01)

(52) U.S. Cl. ..... 411/387.1; 411/387.6; 411/387.8; 411/395; 411/411; 411/424; 411/479

(58) Field of Classification Search ..... 411/386, 411/378, 387.1, 387.5–387.8, 395, 411, 424, 411/426, 477–479; 52/155, 157, 293.3, 295, 52/698

See application file for complete search history.

(56) References Cited

U.S. PATENT DOCUMENTS

| | | | | |
|---|---|---|---|---|
| 3,120,768 | A * | 2/1964 | Williams | 408/59 |
| 3,279,301 | A * | 10/1966 | Fischer | 29/522.1 |
| 3,467,209 | A * | 9/1969 | Chromy | 175/395 |
| 4,157,677 | A * | 6/1979 | Deutschenbaur et al. | 411/548 |
| 4,648,220 | A * | 3/1987 | Gebelius | 52/155 |
| 5,297,900 | A * | 3/1994 | Witzand | 405/259.3 |
| 5,308,203 | A * | 5/1994 | McSherry et al. | 411/31 |
| 5,449,257 | A * | 9/1995 | Giannuzzi | 411/31 |
| 5,529,449 | A * | 6/1996 | McSherry et al. | 411/31 |
| 5,536,121 | A * | 7/1996 | McSherry | 411/31 |
| 5,607,261 | A | 3/1997 | Odom et al. | |
| 5,630,688 | A * | 5/1997 | Tran | 411/387.5 |
| 6,202,367 | B1 * | 3/2001 | Marino et al. | 52/102 |
| 6,523,302 | B2 * | 2/2003 | Zayeratabat | 47/44 |
| 6,607,340 | B2 * | 8/2003 | Petzl et al. | 411/400 |
| 2002/0098045 | A1 | 7/2002 | Fukushima | |
| 2003/0147704 | A1 | 8/2003 | Parker | |
| 2006/0060749 | A1 * | 3/2006 | Dahlstrom | 248/545 |

(Continued)

FOREIGN PATENT DOCUMENTS

| | | |
|---|---|---|
| DE | 8530749 | 3/1986 |

(Continued)

OTHER PUBLICATIONS

ISR/W.O. (in German) PCT/EP2009/004994—Jul. 9, 2009.

(Continued)

*Primary Examiner* — Roberta Delisle
(74) *Attorney, Agent, or Firm* — Simmons Perrine Moyer Bergman PLC

(57) ABSTRACT

The invention relates to a floor anchor (10) made of steel pipe. The floor anchor comprises a hollow shaft segment (14) having an external thread (16) at least in segments, and a head segment adjacent to the shaft segment (14) and facing downward in the anchored state in the floor. The head segment (12) is designed as a drill head and comprises elements for removing earth.

16 Claims, 10 Drawing Sheets

U.S. PATENT DOCUMENTS

| | | | |
|---|---|---|---|
| 2008/0008555 | A1 | 1/2008 | Ardern |
| 2008/0196328 | A1 | 8/2008 | Ardern |

FOREIGN PATENT DOCUMENTS

| | | |
|---|---|---|
| EP | 0110853 | 6/1984 |
| FR | 87641 | 4/1966 |
| GB | 2424906 | 10/2006 |
| WO | 0177444 | 10/2001 |

OTHER PUBLICATIONS

ISR/W.O. (English Translation) PCT/EP2009/004994—Jul. 9, 2009.

* cited by examiner

FLOOR ANCHOR

This application is a continuation application of PCT/EP2009/004994, filed on Jul. 9, 2009, which claims priority to German application DE102009003477.3, filed on Feb. 13, 2009.

The present invention relates to a floor anchor with the characteristics described in the preamble of claim 1.

Screw foundations in the shape of so called floor anchors are used for the anchorage of objects like columns or supporting frames to the ground. Outdoor installations of solar collector are often anchored to the ground with such floor anchors, screw foundations or ground anchors. They are also used for the installation and anchorage of vertically arranged tubes carrying road signs or the like.

A number of different embodiments and sizes of such floor anchors are available. Usually the floor anchors are made from a tubular section that shows a constant diameter over a certain length. In the lower section the floor anchor is conically tapered, so that the floor anchor can be screwed into the ground. The floor anchor is firmly fixed into the ground by the displacement of the soil. To be drilled into the ground, the floor anchor comprises an outside thread. The outside thread can for instance be formed by a metal strip that is welded to the mantle surface of the floor anchor.

Usually the conical section and the cylindrical section are welded together. The conical section is usually produced by a cold molding process. The conical section can especially be produced from a cylindrical tubular section by kneading or hammering this cylindrical tubular section. The lower tip can for instance be formed by a welding and/or by a forging process. The outside thread usually covers the lower part of the tubular section as well as the conical section. The outside thread usually reaches almost up to the lower tip.

Support columns or something alike can be introduced into the inside of the tubular section and fixed to the inside of the tubular section. The fixation can be done by clamping screws at the upper open end of the floor anchor, whereby at least a short end of the upper open end is protruding over the ground.

A floor anchor with a conical section produced by hammering as well as a method for the production of such a floor anchor is described in DE 198 36 370 A1. The body of this floor anchor shows a conical basic shape and a partial conical section. The body is made from a cylindrical tube by hammering. A similar floor anchor with a hammered anchoring section is described in DE 299 23 796 U1.

No problems arise when such floor anchors are screwed into loose soil. When the floor anchor is drilled into the soil, a rigid anchorage is achieved by the displacement of the soil by the thread of the floor anchor. Therefore a floor anchor allows a stable play-free and heavy duty anchorage even in relatively loose soil.

If these floor anchors are used on a stony or solid soil, they often encounter their strength limit and are prone to failure, especially by fracture. Hereby the part between the cylindrical tubular section and the kneaded conical section is especially prone to fracture. When a typical tubular diameter of about 50 mm to 100 mm is used, the steel tube usually has a wall thickness between 1,5 mm and 2,5 mm. Usually the same starting material is used for the production of the lower kneaded or hammered conical section. Therefore the wall thickness increases dramatically in the direction of the tip. The wall thickness in the upper section, close to the weld between the tubular section and the conical section, is only about 1,5 mm and 2,5 mm instead. This conical section therefore cannot withstand high stress because it is especially torsion resistant. When the floor anchor is drilled into a very hard soil, very high torsional stress is applied onto the conical section. This stress is largely introduced into the upper section of the floor anchor and into the section of the weld. Therefore the floor anchor tends to rip at the weld during high stress situations.

One task of the invention is to provide a floor anchor that is very resistant to high stress and that can especially be used on hard soil. A further task of the invention is to provide a very efficient floor anchor that can be produced at a reasonable price.

Said tasks are solved by a device according to the characteristics of the independent claim. Further advantageous embodiments are described in the dependent claims.

The present invention relates to a screw foundation in the form of a floor anchor made from tubular steel or produced from a tube made from another suitable material, for instance a plastic tube or something alike. The floor anchor comprises a hollow shaft section that comprises at least in sections an outside thread. The floor anchor furthermore comprises a head section connected to the shaft section, whereby the head section is pointing downwards when the floor anchor is anchored to the ground. The head section is designed as a drilling head and comprises soil removing elements. According to a preferred embodiment of the floor anchor according to the invention the soil removing elements of the head section are designed as wing-shaped studs. The longitudinal extension of these studs runs almost parallel or in an acute angle to the longitudinal axis of the shaft section. The wing-shaped studs of the head section are separated from each other by constrictions or indentations, whereby the constrictions or indentations are directed towards the central longitudinal axis of the shaft section. When the terms constrictions or indentations are used in the present context, other geometric contours like infoldings should also be considered. In the present context it is essential that the constrictions or indentations or infoldings are each pointing towards the central longitudinal axis and that the constrictions or indentations or infoldings are each separated from an outer surface of the head section by the wing-shaped studs.

The shaft section can optionally show a hollow cylindrical shape with a continuous and constant cross section. Optionally the shaft section can also show a slightly conical shape, whereby the contour preferentially tapers towards the head section. Further shapes of the cross section are also possible and useful. Suitable cross section shapes are for instance a quadrilateral, pentagonal, hexagonal or orthogonal shape or any other suitable shape. Such non circular cross sections can be advantageous with regard to an improved stability after the floor anchor has been drilled into the ground.

The floor anchor serves as a support fundament for supporting rod-shaped objects or support columns, for instance solar collectors, traffic signs or something alike. To anchor the floor anchor into the ground, the lower front of the head section is placed on the floor. The floor anchor is then drilled into the ground with the help of a mechanical drive, whereby a pressure is applied that is directed towards the ground. The head section that is functioning as a drilling head clears away the soil. With the help of the external thread an even penetration of the soil is thereby achieved.

Preferentially the constrictions or indentations or infoldings taper from the shaft section towards the head section and/or the constrictions or indentations or infoldings phase out towards the shaft section into the cylindrical mantle surface of the shaft section. It can be especially useful if the constrictions or indentations or infoldings are phasing out slopes, which taper in an acute angle of about 5° to 15°. An angle of about 10° towards the central longitudinal axis of the floor anchor is especially useful. In this way a head section with a typical length is formed, whereby the length of the head section correlates to about one and a half times the diameter of the tubular shaft section. The head section can also be longer, whereby the acute angle of the constrictions or indentations phasing out in the direction of the upper shaft section is probably smaller that 10°. Depending on the desired design, embodiments with a shorter head section are also possible. Thereby the angle of the constrictions or indentations phasing out in the direction of the upper shaft section is probably larger than 10°.

The head section can comprise at least three wing-shaped studs arranged regularly and/or symmetrically. The head section furthermore comprises constrictions or indentations or infoldings complementary to the studs, whereby the studs and the constrictions alternate. The studs and the constrictions preferentially alternate with regular distances in between. Optionally the head section can comprise four wing-shaped studs and constrictions or indentations arranged regularly and/or symmetrically. A further alternative embodiment of a floor anchor features a head section comprising at least five or six wing-shaped studs and complementary constrictions or indentations arranged regularly and/or symmetrically.

The studs and constrictions or indentations can optionally be inclined towards the central longitudinal axis in an acute angle. It is furthermore possible that the studs and constrictions or indentations show a spiral shaped course. The inclination is sensibly aligned in such a way that the drilling of the floor anchor into the ground can be achieved more easily because the inclination of the studs and constrictions or indentations provides a thread like effect. Such alternative embodiments are especially advantageous in heavy and very hard soils by easing the drilling of the support foundation into the ground.

The constricted or indented wall sections of the head section are preferentially spaced apart from each other and not fully pressed or pinched together. Thereby a front opening is formed between the spaced apart and constricted or indented wall sections of the head section. When the floor anchor is drilled into the ground, the soil gets cleared to the side and slightly compressed by the drill like design of the head section. When the floor anchor is drilled into the soil, this leads to an increased lateral soil pressure onto the mantle surface areas of the shaft section. This guarantees an especially stable fit of the floor anchor in the ground. Experiments have shown that the front opening does not lead to an increased entry of soil into the inside of the tube. At the most the head section and occasionally a very small part of the shaft section are filled with soil when the floor anchor has been drilled into the ground. The width of the slits formed between the spaced apart walls of the indented sections can for instance correlate with the wall thickness of the steel tube, especially having two times or three times the thickness of the steel tube. Such an opening can advantageously be used as zinc outled for the galvanic zinc coating of the floor anchor. Therefore no separate zinc outlet has to be drilled into the floor anchor.

Optionally the wall sections pressed together or the front edges of the head section can be welded together at least in sections. This increases the stability of the floor anchor, especially when the floor anchor is used on very hard ground. It can be of further advantage when the lateral edges of the wing-like studs are trimmed or provided with a chamfer thereby forming a kind of tip when seen from a lateral view.

It is particularly favorable when the upper shaft section and the lower head section are formed in a single piece from a single, continuous section of a steel tube. The floor anchor preferentially shows an almost constant wall width in the upper cylindrical shaft section and the lower head section. Such a floor anchor can be produced quickly and rather inexpensively, because no connective weld is required. The connective weld would on the one hand lead to a higher production effort. On the other hand the connective weld would lead to a weakening of the material structure. This would especially lead to a high risk of material failure when the floor anchor is used on very hard ground.

A further embodiment of a floor anchor according to the invention has a lower centering point. The centering point largely aligns with the central longitudinal axis. The centering point can especially be arranged between the constrictions or indentations and/or the centering point can especially be welded to the constrictions or indentations. The centering point facilitates the mounting of the floor anchor onto the ground and prevents a movement of the floor anchor away from its intended installation point before it is drilled into the ground.

The outside thread of the floor anchor or screw foundation can for instance be formed by a metal strip, whereby the narrow side of the metal strip runs around the hollow cylindrical shaft section and/or whereby the narrow side of the metal strip runs around at least a part of the lower head section in a spiral or helical way. The metal strip is welded to the outer mantle surface of the floor anchor at least at selective points and/or in sections. The outside thread preferentially extends in a continuous way and with an almost constant inclination between a lower part of the cylindrical section up to the lower front of the head section. Usually the thread only extends along a part of the shaft section where appropriate and does not affect the indented parts of the head section. The thread may stretch over the entire shaft section if required or the thread may just stretch over a part of the shaft section.

The floor anchor according to the invention is very stable and resistant. It can be used on very difficult grounds without the risk of fractures of the material. Due to the lack of a weld between the upper shaft section and the lower head section, there is no risk of failure or fracture of the material in this part. The floor anchor has an almost constant wall thickness, even in the lower head section that is designed as a drilling head. Therefore all sections of the floor anchor have torsion elastic properties. Therefore the floor anchor can withstand high torsional stress when it is drilled into difficult and very solid and/or especially hard ground. A floor anchor according to the invention can therefore withstand torsional stress much better than a conventional floor anchor. Because of their stiffness, conventional floor anchors cannot give way to torsional stress sufficiently. When overloading occurs conventional floor anchors tend to fail suddenly, especially by cracking.

Drilling experiments with floor anchors according to the invention have shown that the penetration process essentially comprises two phases. During the first phase, especially when the floor anchor is used on very hard ground or when the floor anchor should penetrate a compacted soil layer like a layer made from gravel or something alike, the floor anchor needs to be pressed and rotated with a relatively high axial pressure. The head section acts as a drilling head, whereby the wing-like studs provide the clearing of the drill hole by removing the soil. After the hard layer has been penetrated, the floor anchor can be rotated with a smaller axial pressure. The work of the floor anchor can be compared to a drilling screw, whereby the outside thread supports the drilling into the soil. All the experiments have shown that a pre-drilling or another pre-preparation of the drilling hole is neither necessary nor useful.

Steel tubes are especially useful starting material for the production of floor anchors according to the invention. The outside thread is welded to the steel tube. The floor anchor can also be made from any other suitable material, for instance injection-molded plastics can be used, whereby the plastics can additionally be reinforced by fibers. Such plastic pegs can optionally be produced as solid plastic pegs. In these embodiments no anchoring device can be inserted into the peg. Therefore the attachment of such an anchoring device is preferentially done by a screw type flange or another suitable connection.

If the term floor anchor is used in the present context, it is used as a synonym for the term screw foundation, ground anchor etc. that can also be used. The terms may be used differently but usually refer to the same object.

Further characteristics, aims and advantages of the present invention emerge from the following detailed description of a preferred embodiment of the invention. These embodiments serve as a non limiting example and refer to the accompanying drawings. Same parts are basically given the same reference numbers and are therefore not repeatedly explained.

Figure 1:
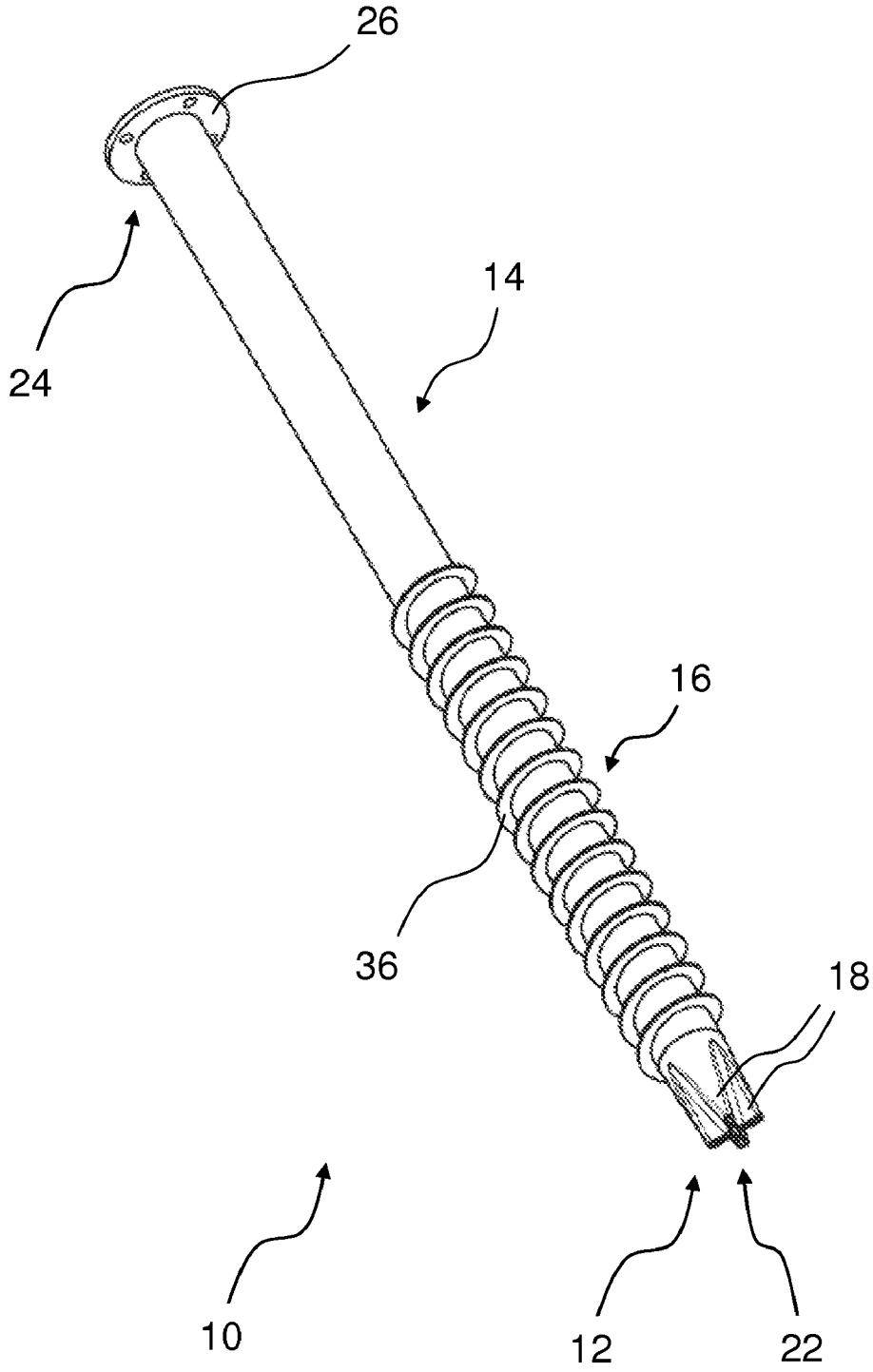
FIG. 1 shows a schematic perspective view of an embodiment of a floor anchor according to the invention.
Figure 2:
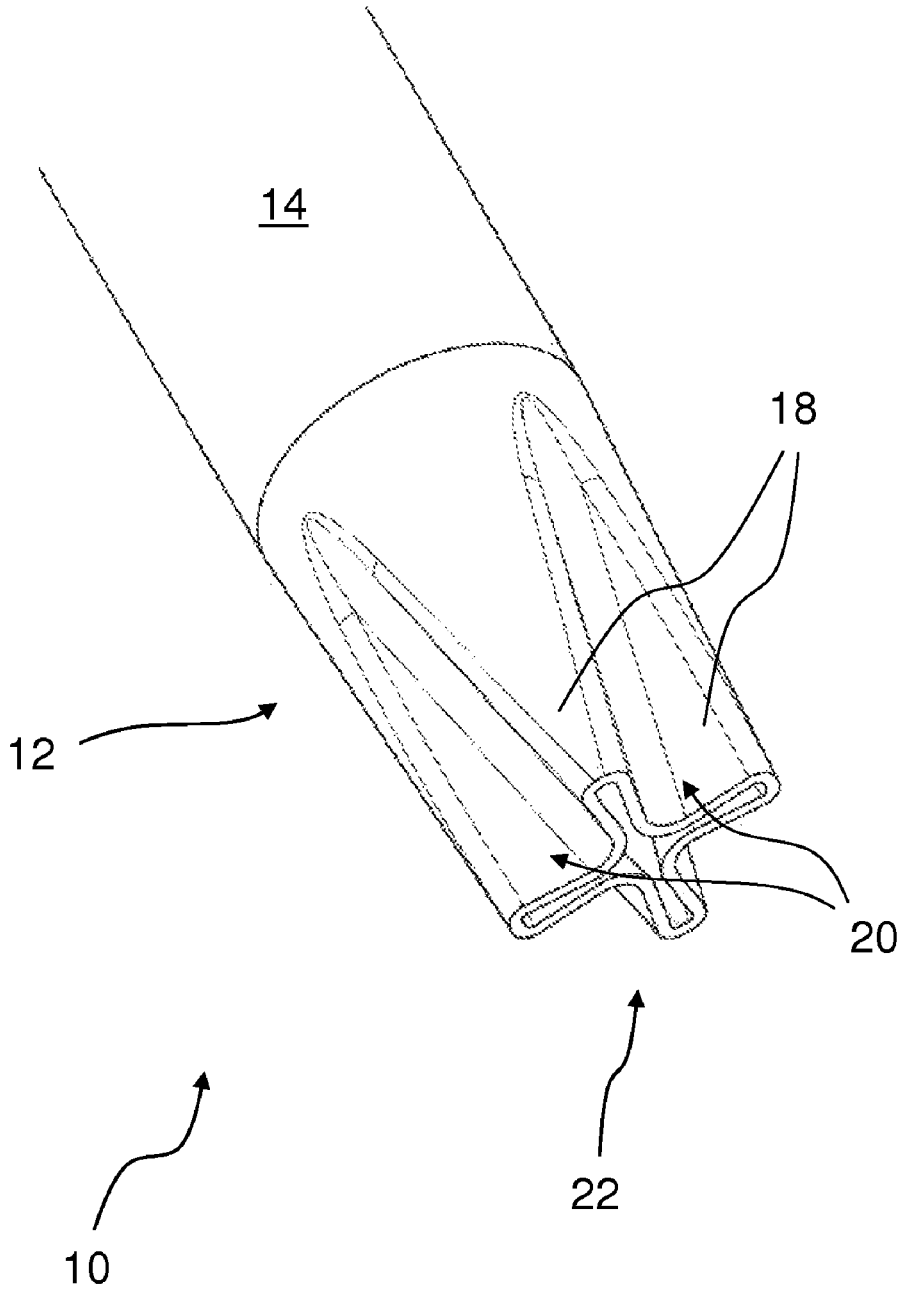
FIG. 2 shows a detailed perspective view of a head section of a floor anchor designed as a drilling head according to FIG. 1.
Figure 3:
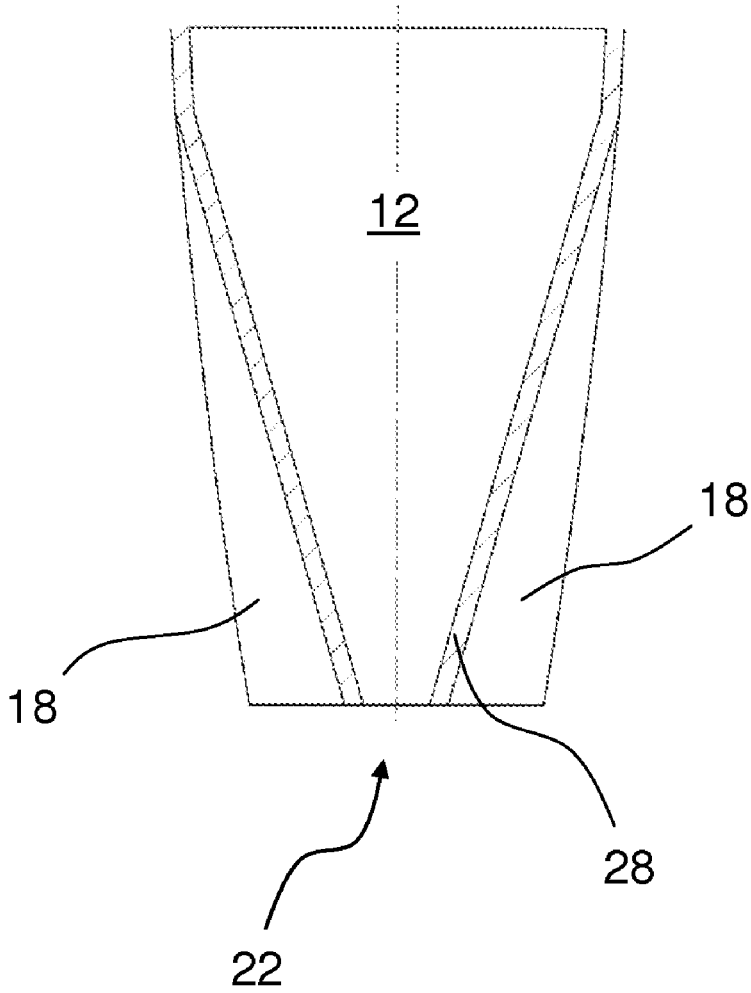
FIG. 3 shows a longitudinal section of the head section according to FIG. 2.

With regards to FIGS. 1 to 10 various embodiments of a floor anchor 10 according to the invention are described below. If the term floor anchor is generally used in the present context, it is used as a synonym for the term "ground anchor", "screw foundation" or something similar. FIG. 1 shows a schematic perspective view of a first embodiment of a floor anchor 10 according to the invention. FIG. 2 shows a perspective view of a detail of the head section 12 of the floor anchor 10 according to FIG. 1, whereby the head section 12 is designed as a drilling head. The longitudinal section of FIG. 3 again shows the head section 12 according to FIG. 2.

A floor anchor 10 according to the represented embodiment comprises a hollow cylindrical shaft 14. A lower part of the shaft 14 is provided with an outside thread 16. The floor anchor 10 furthermore comprises a head section 12 joined to the shaft 14, whereby the head section 12 is pointing downwards when the floor anchor 10 is anchored to the ground. The head section 12 is designed as a drilling head and comprises soil removing elements. These soil removing elements of the head section 12 are formed by wing-like studs 18. In the embodiments according to FIGS. 1 to 7 the longitudinal extension of these studs 18 runs always almost parallel to the longitudinal axis of the shaft section 14 or the whole floor anchor 10. The wing-like studs 18 of the head section 12 are separated from each other by constrictions or indentations 20, whereby the constrictions or indentations 20 are pointing towards the central longitudinal axis of the shaft section 14 or the head section 12.

The floor anchor 10 can be used as screw foundation for the support of rod-shaped objects or support columns, for instance solar collectors, traffic signs or something alike. To anchor the floor anchor 10 into the ground, the lower front 22 of the head section 12 is placed on the ground and the floor anchor 10 is then drilled into the ground with the help of a mechanical drive. Thereby a pressure is applied that is directed towards the ground. The head section 12, which is functioning as a drilling head, clears away the soil. With the help of the external thread 16 an even penetration of the soil is achieved. The floor anchor 10 usually comprises a connective flange 26 located at the upper end 24 opposite to the head section 12. The upper end 24 is usually protruding from the ground. The connective flange 26 is used for the connection of an object (not shown) to the floor anchor 10, so that the object is anchored securely to the ground.

As shown in the embodiment, the constrictions or indentations 20 taper from the head section 12 towards the shaft section 14 and phase out into the cylindrical mantle surface of the shaft section 14. Usually the inclination phases out in an acute angle of about 10° towards the longitudinal extension of the floor anchor 10. In this way the head section 12 shows a typical length, whereby the length of the head section 12 usually corresponds to about one and a half times the tube diameter of the shaft section 14.

Figure 5:
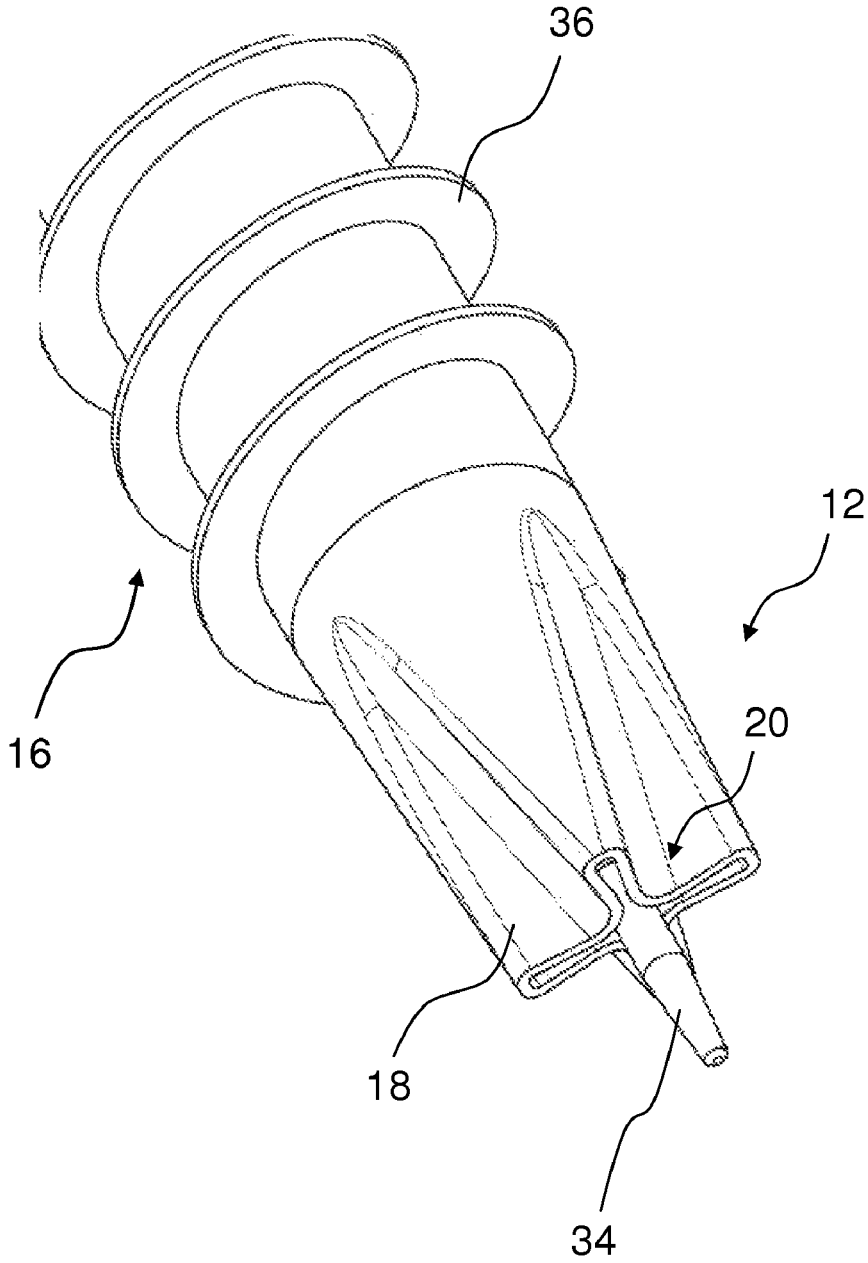
FIG. 5 shows a detailed perspective view of the head section with the centering point of a floor anchor according to FIG. 4.
Figure 6:
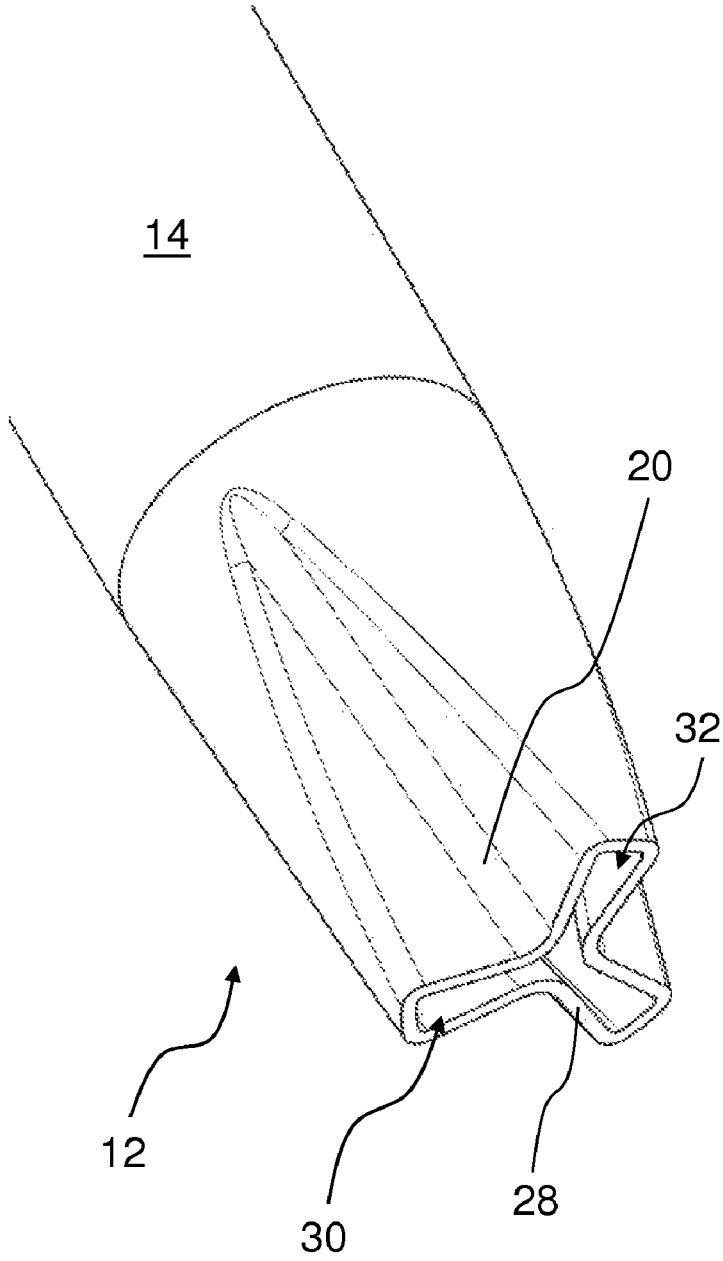
FIG. 6 shows a detailed perspective view of an alternative embodiment of the head section.
Figure 7:
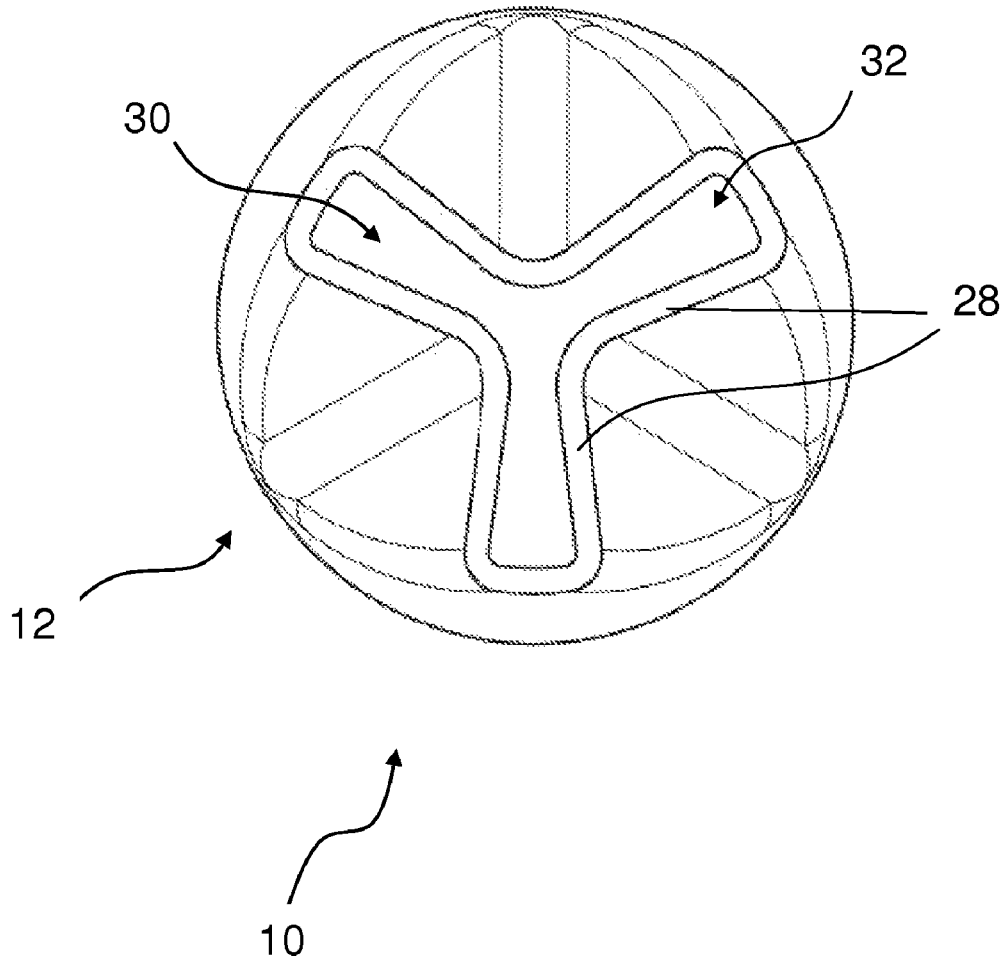
FIG. 7 shows a top view from a head section according to FIG. 6.

Optionally the head section 12 of the floor anchor 10 can comprise at least three wing-shaped studs 18 and constrictions or indentations 20 arranged regularly and/or symmetrically as shown in the embodiments according to FIGS. 6 and 7. Optionally the head section 12 of the floor anchor 10 can comprise four wing-shaped studs 18 and constrictions or indentations 20 arranged regularly and/or symmetrically as shown in the embodiments according to FIGS. 1 to 5. A further embodiment of the floor anchor 10, which is not shown here, can comprise at least five or six wing-shaped studs 18 and constrictions or indentations 20 arranged regularly and/or symmetrically.

Figure 8:
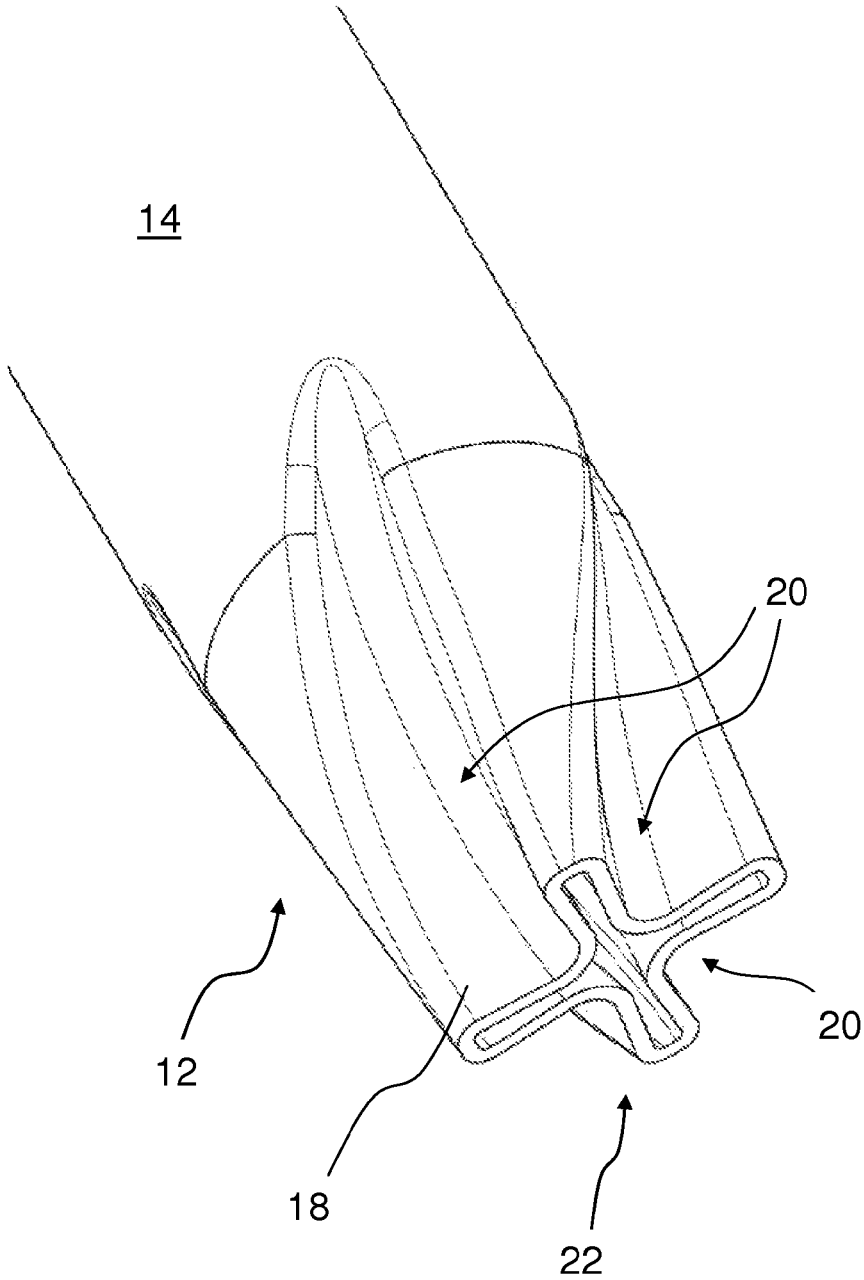
FIG. 8 shows a detailed perspective view of another alternative embodiment of the head section.
Figure 9:
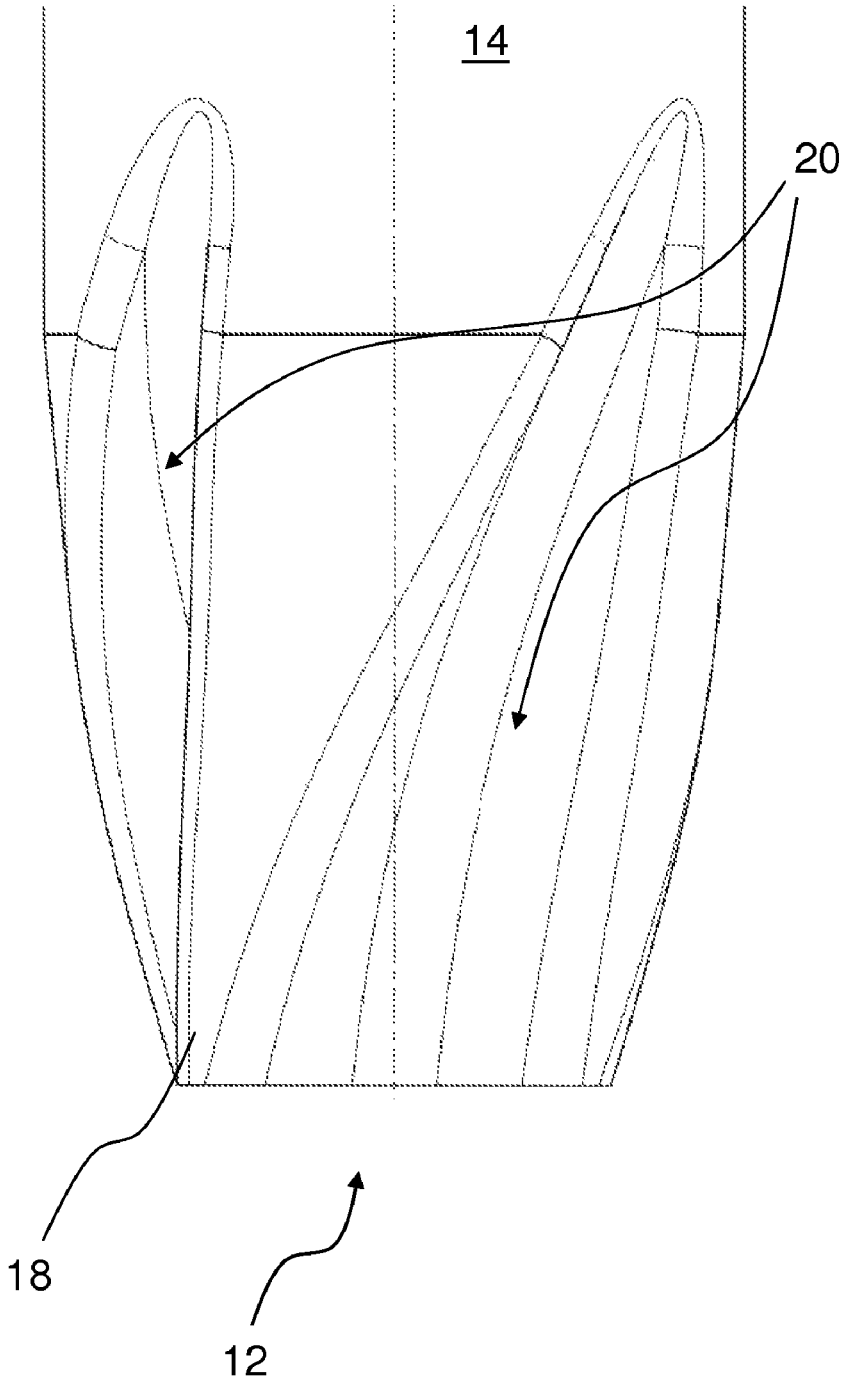
FIG. 9 shows a lateral view of the head section according to FIG. 8.
Figure 10:
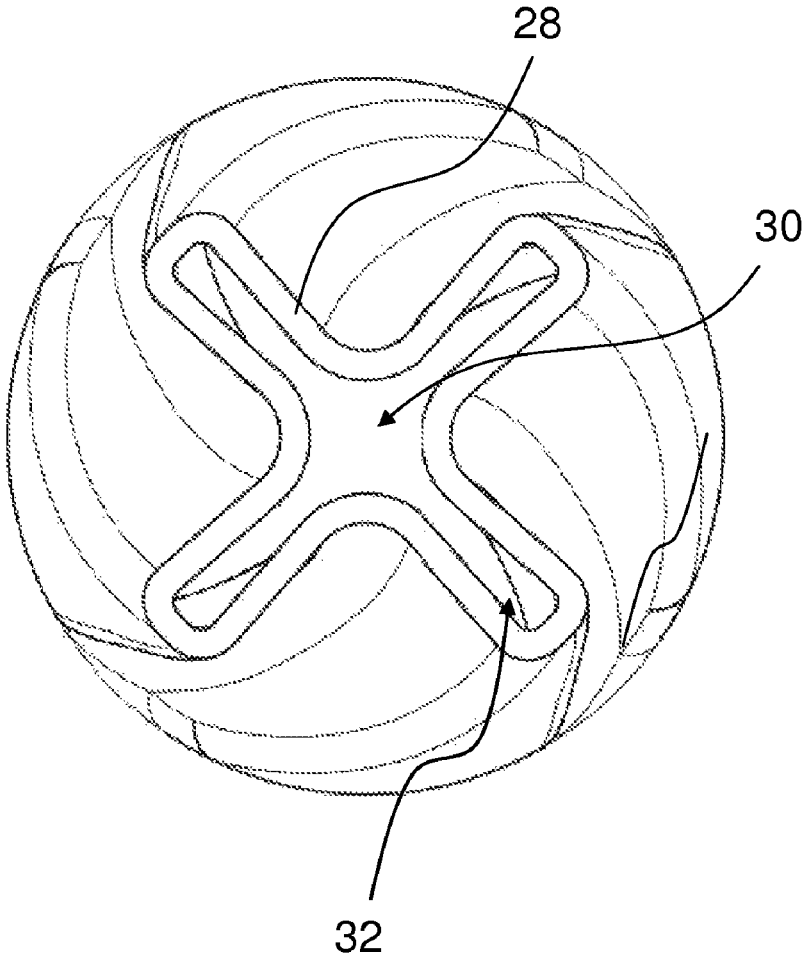
FIG. 10 shows a top view of a head section according to FIG. 8 and FIG. 9.

The studs 18 and constrictions or indentations 20 can optionally show a spiral shaped course as shown in the embodiments according to the FIGS. 8 to 10. The inclination and curvature of the studs 18 and their complementary indentations 20 are preferentially aligned in such a way to facilitate the drilling of the floor anchor 10 into the ground. Hereby the inclination provides a thread-like effect. Such a variant can be especially useful for the use on difficult and very hard soils, because with a floor anchor 10 according to the invention the drilling of the screwing foundation into the ground can be achieved more easily.

As can be easily seen in all drawings, the constricted or indented wall sections 28 of the head section 12 are spaced apart from each other. The wall sections 28 are not fully pressed or squeezed together. A front opening 30 is formed between the spaced apart, constricted or indented wall sections 28 of the head section 12. Depending on the number of indentations 20 the front opening 30 resembles a wing with three or four arms (see FIG. 7 and FIG. 10). When the floor anchor 10 is drilled into the ground, the soil gets cleared to the side and slightly compressed by the drill like design of the head section 12. This leads to an increased lateral soil pressure onto the mantle surface areas of the shaft section 14. This guarantees an especially stable fit of the floor anchor 10 in the ground. The width of the slits 32 formed between the spaced apart walls 28 of the indented sections can for instance correlate with the wall thickness of the steel tube. The width of the slits 32 can especially amount to about two times or three times the wall thickness of the steel tube. Such an opening 30 can advantageously be used as a zinc outlet for the galvanic zinc coating of the floor anchor 10 that finalizes the production process. Therefore no separate zinc outlet has to be drilled into the floor anchor 10.

The upper shaft section 14 and the lower head section 12 are produced as a single piece from a single continuous section of a tubular steel. The floor anchor 10 shows an almost constant wall thickness in the upper cylindrical shaft section 14 and the lower at least partially deformed head section 12. A connective weld is not required.

Figure 4:
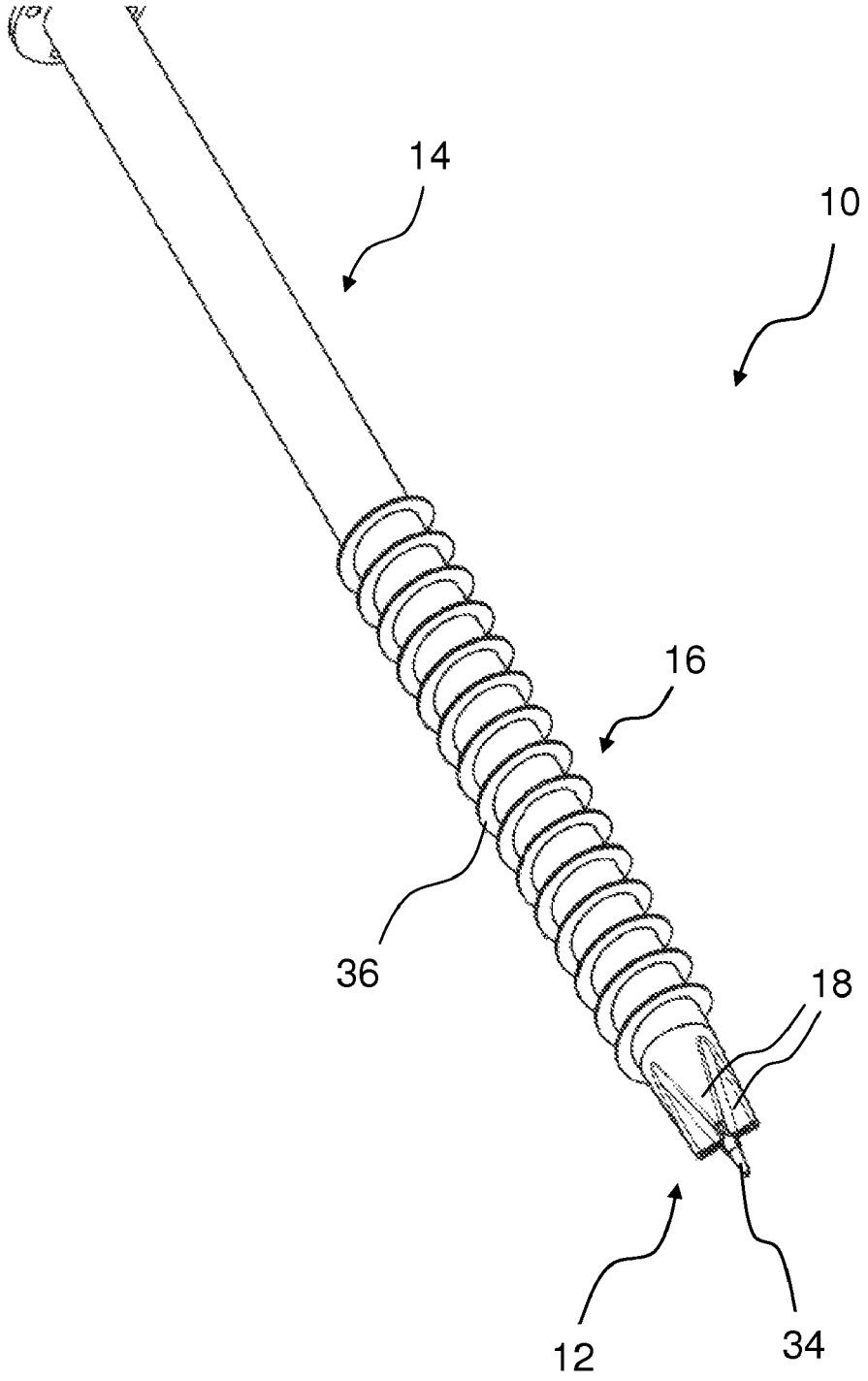
FIG. 4 shows a schematic perspective view of an alternative embodiment of a floor anchor according to the invention with a centering point arranged at the front of the head section.

The schematic perspective view of FIGS. 4 and 5 shows a further embodiment of a floor anchor 10 according to the invention with a centering point 34 located at the front of the head section 12. The centering point 34 aligns with the central longitudinal axis of the floor anchor 10. The shape and size of the centering point 34 is calculated in a way that the centering point 34 can be arranged between the indentations 20 or constrictions and that the centering point 34 can be welded to the indentations 20 or constrictions. The centering point 34 facilitates the mounting of the floor anchor 10 especially onto hard ground and prevents a movement of the floor anchor 10 away from its intended installation point before the floor anchor 10 is drilled into the ground. In order to weld the centering point 34 to the front 22 of the opening 30, the centering point 34 is made of a weldable metal, especially construction steel.

The outside thread 16 of the floor anchor 10 or the screw foundation is made from a metal strip 36. A narrow side of the metal strip 36 spirally or helically runs around the hollow cylindrical shaft section 14 and/or the narrow side of the metal strip 36 spirally or helically runs around at least a part of the lower head section 12. The narrow side of the metal strip 36 is welded to the outer mantle surface of the floor anchor 10 at selected points and/or in sections. According to FIG. 1 the outside thread 16 only extends along a part of the shaft section 14 and does not affect the indented parts 20 of the head section 12. The thread 16 may stretch over the entire shaft section 14 if required or the thread 16 may just stretch over a part of the shaft section 14.

List of Reference Numbers

10 floor anchor
12 head section
14 shaft section
16 outside thread
18 stud
20 indentation
22 lower front
24 upper end
26 connective flange
28 indented wall section
30 opening
32 slit
34 centering point
36 metal strip The invention has been described with reference to a preferred embodiment. Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

I claim:

1. Floor anchor (10) made from tubular steel, comprising a hollow shaft section (14) that shows at least in sections an outside thread (16), furthermore comprising a head section (12) connected to the shaft section (14), whereby the head section (12) is pointing downwards when the floor anchor (10) is anchored into the ground, characterized in that the head section (12) is designed as a drilling head and comprises soil removing elements, whereby the soil removing elements of the head section (12) are formed as wing-shaped studs (18), whereby the longitudinal extension of these studs (18) runs about parallel or in an acute angle to a longitudinal axis of the shaft section (14).

2. Floor anchor (10) according to claim 1, whereby the wing-shaped studs (18) of the head section (12) are separated from each other by constrictions or indentations (20) pointing towards the central longitudinal axis of the shaft section (14).

3. Floor anchor (10) according to claim 2, whereby the constrictions or indentations (20) each taper from the head section (12) towards the shaft section (14) or whereby the constrictions or indentations (20) phase out towards the shaft section (14) into its cylindrical mantle surface.

4. Floor anchor (10) according claim 3, whereby the head section (12) comprises at least three wing-shaped studs (18) and complementary constrictions or indentations (20), whereby the wing-shaped studs (18) and the complementary constrictions or indentations (20) are arranged regularly or symmetrically.

5. Floor anchor (10) according to claim 3, whereby the head section (12) comprises at least four wing-shaped studs (18) and constrictions or indentations (20), whereby the wing-shaped studs (18) and the constrictions or indentations (20) are arranged regularly or symmetrically.

6. Floor anchor (10) according to claim 3, whereby the head section (12) comprises at least five or six wing-shaped studs (18) and constrictions or indentations (20), whereby the wing-shaped studs (18) and the constrictions or indentations (20) are arranged regularly or symmetrically.

7. Floor anchor (10) according to claim 3, whereby an outside thread (16) is formed from a metal strip (36), whereby a narrow side of the metal strip (36) spirally runs around the cylindrical shaft section (14) or whereby a narrow side of the metal strip (36) spirally runs around at least a part of the lower head section (12), whereby the narrow side of the metal strip (36) is welded to the outer mantle surface of the cylindrical shaft section (14) or to the outer mantle surface of the lower head section (12) of the floor anchor(10) at least at selective points or in sections.

8. Floor anchor (10) according to claim 2, whereby the studs (18) and the constrictions or indentations (20) are each inclined towards the central longitudinal axis in an acute angle.

9. Floor anchor (10) according to claim 2, whereby the studs (18) and the constrictions or indentations (20) each show a spiral-shaped course.

10. Floor anchor (10) according to claim 2, whereby constricted or indented wall sections (28) of the head section (12) are spaced apart from each other.

11. Floor anchor (10) according to claim 10, whereby a front opening (30) is formed between the spaced apart constricted or indented wall sections (28) of the head section (12).

12. Floor anchor (10) according to claim 1, whereby the upper shaft section (14) and the lower head section (12) are formed as a single piece from single, continuous tubular steel.

13. Floor anchor (10) according to claim 1, whereby the floor anchor (10) comprises a lower centering point (34).

14. Floor anchor (10) according to claim 13, whereby the lower centering point (34) largely aligns with the central longitudinal axis and whereby the lower centering point (34) is arranged between the constrictions or indentations (20) or whereby the lower centering point (34) is welded to the constrictions or indentations (20).

15. Floor anchor (10) according to claim 1, whereby the cylindrical upper shaft section (14) and the lower head section (12) each show a substantially uniform wall thickness.

16. Floor anchor (10) according to claim 1, whereby an outside thread (16) is formed from a metal strip (36), whereby a narrow side of the metal strip (36) spirally runs around the shaft section (14) and whereby a narrow side of the metal strip (36) spirally runs around at least a part of the head section (12), whereby the narrow side of the metal strip (36) is welded to the outer mantle surface of the shaft section (14) and to the outer mantle surface of the head section (12) of the floor anchor (10) at least at selective points or in sections.

* * * * *